US006989638B2

(12) United States Patent
Namba et al.

(10) Patent No.: US 6,989,638 B2
(45) Date of Patent: Jan. 24, 2006

(54) DISCHARGE LAMP LIGHTING CIRCUIT

(75) Inventors: Takanori Namba, Shizuoka (JP); Masayasu Ito, Shizuoka (JP)

(73) Assignee: Koito Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 10/879,579

(22) Filed: Jun. 30, 2004

(65) Prior Publication Data

US 2005/0062435 A1 Mar. 24, 2005

(30) Foreign Application Priority Data

Jul. 2, 2003 (JP) ..... P. 2003-190253

(51) Int. Cl.
*G05F 1/00* (2006.01)

(52) U.S. Cl. ..... 315/291; 315/307; 315/224

(58) Field of Classification Search ..... 315/291, 315/307, 297, 224, 225, 209 R
See application file for complete search history.

(56) References Cited

U.S. PATENT DOCUMENTS 6,163,115 A * 12/2000 Ishizuka ..... 315/308
6,583,587 B2 * 6/2003 Ito et al. ..... 315/308
6,750,620 B2 * 6/2004 Suzuki ..... 315/291

FOREIGN PATENT DOCUMENTS

JP 9-330795 A 12/1997

* cited by examiner

*Primary Examiner*—Tuyet Thi Vo
(74) *Attorney, Agent, or Firm*—Sughrue Mion, PLLC

(57) ABSTRACT

A discharge lamp lighting circuit includes an emission acceleration controller for detecting a lamp voltage for the discharge lamp, and supplying power greater than a rated value when the discharge lamp is initially lighted, and for gradually reducing the power supplied thereafter so as to shift the discharge lamp to a steady state. Power control is provided so that the power supplied to the discharge lamp is reduced in accordance with a rise in the voltage of a capacitor, and a charge current is supplied to the capacitor by current sources that provide a current that depends on the time elapsed since the lighting of the discharge lamp started and a second current that depends on a lamp voltage.

16 Claims, 5 Drawing Sheets

DISCHARGE LAMP LIGHTING CIRCUIT

This application claims foreign priority based on Japanese patent application JP 2003-190253, filed on Jul. 2, 2003, the contents of which is incorporated herein by reference in its entirety.

BACKGROUND OF THE INVENTION

1. Field of the Invention

The present invention relates to a discharge lamp lighting circuit which uses a capacitor to control the supply of transient power to obtain a satisfactory starting performance for a discharge lamp.

2. Description of the Related Art

A related art discharge lamp lighting circuit configuration includes a direct-current power source circuit, a DC-AC converter and a starting circuit (i.e., a starter). With this related art configuration, the discharge lamp lighting circuit (while in a steady state) supplies a rated power to a discharge lamp.

To quickly raise the luminous flux of the discharge lamp, during a transition period immediately following the lighting of the discharge lamp, power exceeding the rated power is supplied to the discharge lamp to accelerate the emission of light (see JP-A-9-330795, for example).

For a related art circuit for lighting a discharge lamp containing mercury, for example, during a transition period extending from immediately following the lighting of the discharge lamp until it is shifted to the steady state, a lamp current (or power to be supplied) corresponding to a lamp voltage is regulated, i.e., a control process is performed based on a so-called control line.

For a lighting circuit for a discharge lamp that contains either no mercury or only a small amount of mercury, starting performance variances constitute a problem when the control method employed uses a control line as a reference. Therefore, predictive control is required for the change in power.

However, with the related art configuration, there are various inconveniences associated with the control arrangement for reducing the starting time for a discharge lamp.

For example but not by way of limitation, costs rise because either the structure of a circuit is complicated or the scale of the circuit is increased. Further, there is a design problem (e.g., that there is nothing in common with the circuit structure for a discharge lamp that contains mercury and the circuit structure for a discharge lamp that contains no mercury or only a small amount of mercury) and the multiplicity of the use of the circuit is poor.

SUMMARY OF THE INVENTION

It is an object of the present invention to provide a discharge lamp lighting circuit which can increase the starting performance of a discharge lamp without complicating the circuit structure or increasing the circuit size. However, the present invention can be realized without this object, or any object.

To achieve this objective, the invention includes the following configuration.

A discharge lamp lighting circuit includes an emission acceleration controller for detecting a lamp voltage for a discharge lamp and for supplying power greater than a rated value when the discharge lamp is initially lighted, and for, thereafter, gradually reducing the supplied power to shift the discharge lamp to a steady state.

Power control is provided so that the power supplied to the discharge lamp is reduced in accordance with a rise in the voltage of a capacitor that constitutes the emission acceleration controller.

A charge current is supplied to the capacitor, which constitutes the capacitor of the emission acceleration controller, by a plurality of current sources that provide a first current, which depends on the time that has elapsed since the lighting of the discharge lamp started, and a second current, which depends on a lamp voltage.

Therefore, according to this invention, to control power supplied to the discharge lamp during a transition period, a capacitor is provided that constitutes an emission acceleration controller and that is charged by using currents supplied by a plurality of power sources. With this arrangement, the circuit structure can be simplified without a control line. The configuration of this invention can be applied regardless of whether a discharge lamp contains mercury, as a luminous material, or contains no mercury or only a small amount. For example, when the invention is employed for a lighting circuit for a discharge lamp that does not contain mercury, the starting period can be reduced and stabilized Thus, the occurrence of overshoot or undershoot can be prevented in accordance with the rising characteristic of a luminous flux.

DETAILED DESCRIPTION OF THE INVENTION

Figure 1:
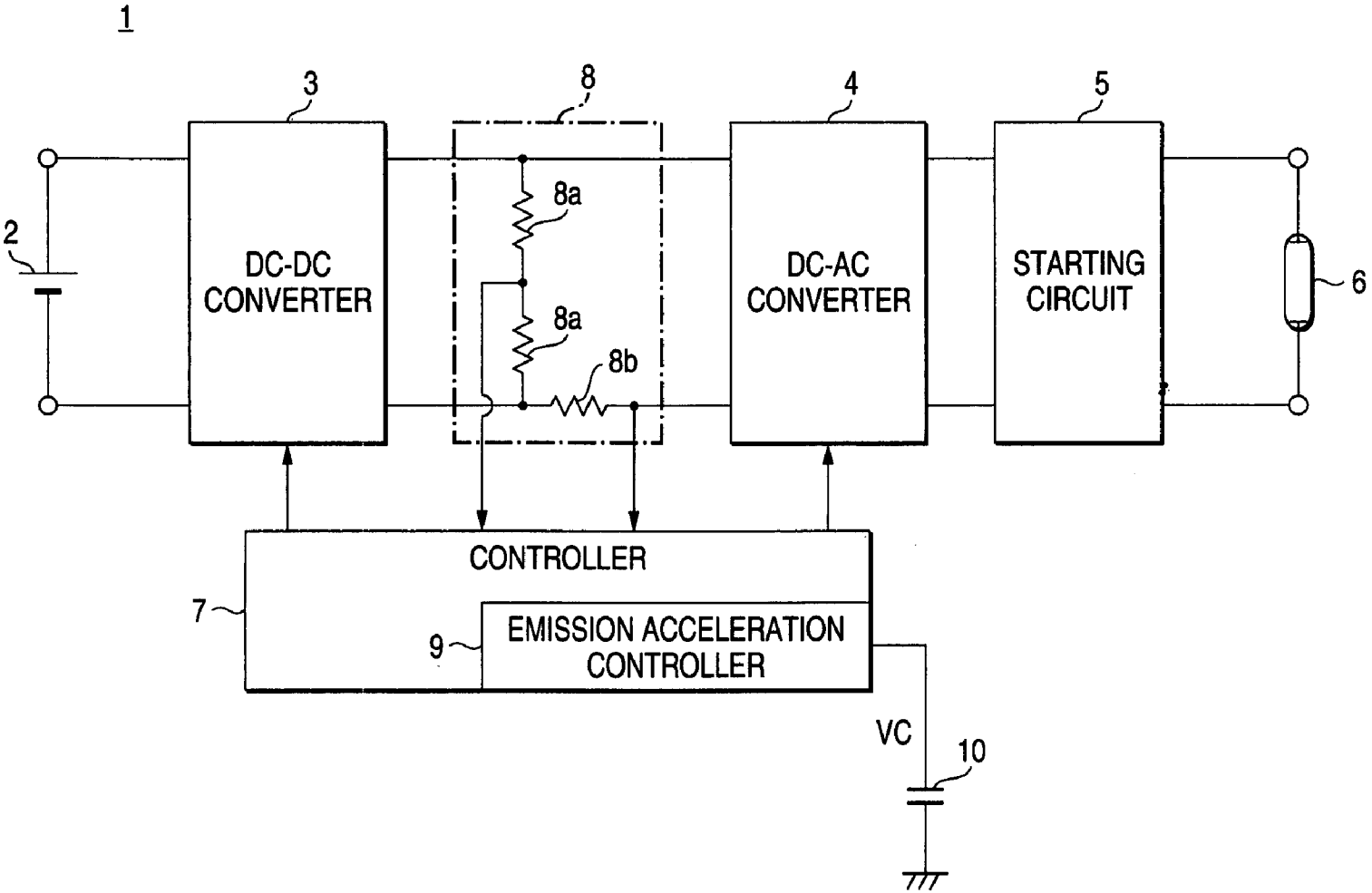
FIG. 1 is a block diagram showing an exemplary, non-limiting basic configuration of a discharge lamp lighting circuit according to the present invention.

An exemplary, non-limiting embodiment of the present invention is shown in FIG. 1. A discharge lamp lighting circuit 1 comprises a direct-current power source 2, a DC—DC converter 3, a DC-AC converter 4 and a starting circuit 5.

The DC—DC converter 3 raises or lowers the voltage of a current received from the DC power source 2, and outputs a desired DC voltage. The output voltage of the DC—DC converter 3 varies in accordance with a control signal received from a controller 7, as described below. The DC—DC converter 3 can be a DC—DC converter (e.g., a chopper or a flyback type) having a switching regulator.

The DC-AC converter 4 changes the output voltage of the DC—DC converter 3 into an AC voltage, and supplies the AC voltage to a discharge lamp 6. The DC-AC converter 4 can include a bridge circuit (a full bridge circuit or a half bridge circuit) including a plurality of semiconductor switching devices, and a driver for the bridge circuit.

The starting circuit 5 generates a high voltage signal (start pulse) and supplies this signal to the discharge lamp 6 to be activated. The high voltage signal is superimposed with the AC voltage output by the DC-AC converter 4, and the resultant signal is applied to the discharge lamp 6. In this exemplary, non-limiting embodiment, the discharge lamp 6 either contains mercury, does not contain mercury or contains only a small amount of mercury.

The following arrangements can be employed for a detector for detecting the voltage or the current of the discharge lamp 6.

(A) To directly detect the voltage or the current of a discharge lamp, a current detection device (a shunt resistor or a detection transformer) is connected to the discharge lamp to detect the current across the current detection device.

(B) An equivalent voltage for the lamp voltage, or the lamp current of a discharge lamp, is detected.

In FIG. 1, the arrangement (B) is shown, and a detector 8 is between the DC—DC converter 3 and the DC-AC converter 4. The detector 8 includes a voltage divided resistor 8*a*, a voltage detector for detecting a DC output voltage using the voltage-divided resistor 8*a*, and a current detector using a current detection resistor 8*b*. The detection signals are transmitted to the controller 7.

The controller 7 has a power control function in the steady state of the discharge lamp 6 and a power control function in the transient state. The controller 7 controls the power supplied to the discharge lamp 6 in the steady state (constant power control), in accordance with a detection signal for the voltage applied to the discharge lamp 6, and a detection signal for the current flowing through the discharge lamp 6.

Also, before performing this power control process, the controller 7 controls the output of the DC—DC converter 3 to control the power supplied to the discharge lamp 6 during a transition period. The controller 7 includes a function for driving the DC-AC converter 4 and a fail-safe function for determining when an abnormality has occurred in the state or the operation of the circuit.

In the controller 7, an emission acceleration controller 9 relates to the present invention detects a lamp voltage for the discharge lamp 6, supplies power having a rated value when the discharge lamp 6 is initially lighted, and gradually reduces the supplied power thereafter to shift the discharge lamp 6 to the steady state. The emission acceleration controller 9 also provides power control, so that the power supplied to the discharge lamp 6 is reduced in accordance with a rise in the voltage of a capacitor 10 that constitutes the emission acceleration controller 9 (in FIG. 1, the capacitor 10 is an external device).

For a discharge lamp that contains mercury, since the lamp voltage rises prior to the rise in the luminous flux, the power that is to be supplied can be controlled while the lamp voltage is monitored. For a discharge lamp that contains no mercury, or only a small amount, the lamp voltage rise does not always occur prior to the rise in the luminous flux. Thus, predictive control is required for a change in the power supplied during the transition period.

Figure 2:
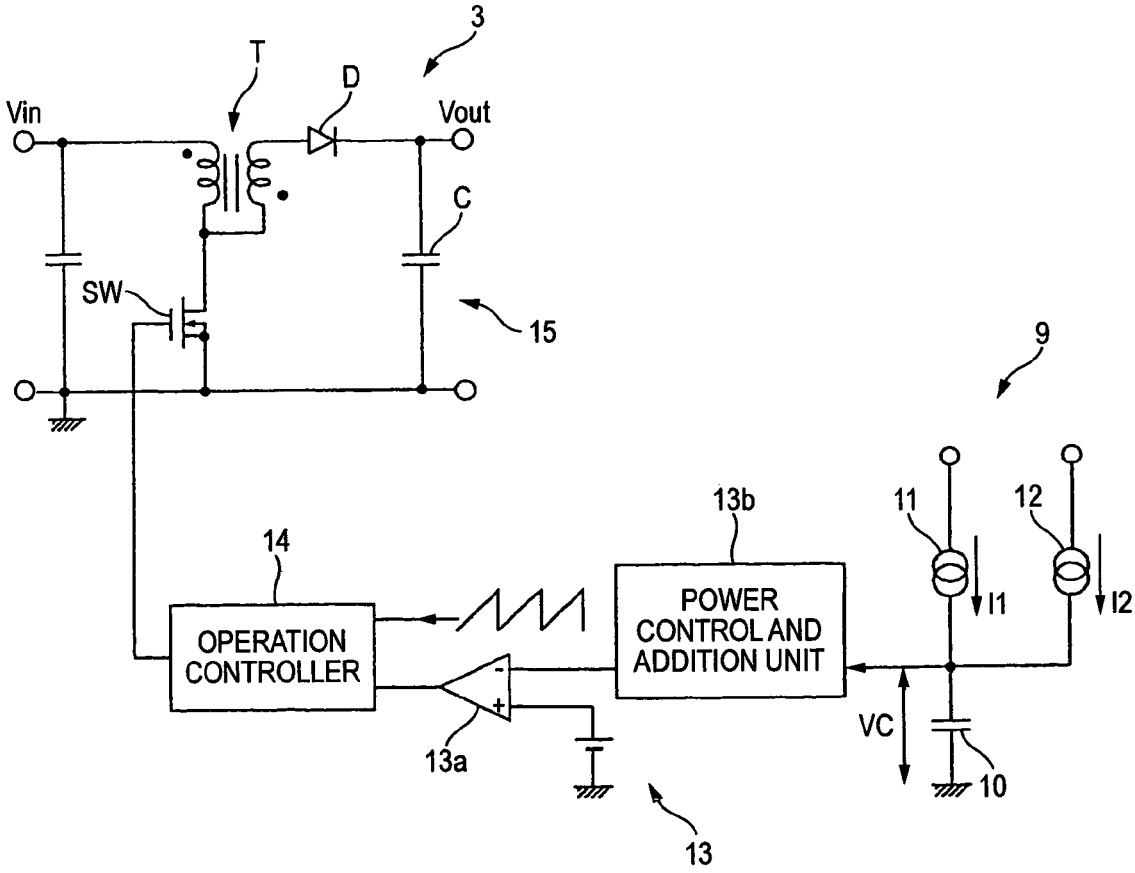
FIG. 2 is a schematic diagram for explaining an emission acceleration controller according to an exemplary, non-limiting embodiment of the present invention.

FIG. 2 is a schematic diagram for explaining the emission acceleration controller 9, and illustrates the capacitor 10, a plurality of current sources 11 and 12, a power controller 13, an operation controller 14 and an essential portion of the DC—DC converter 3.

The current source 11 (the current value is referred to as an "I1") and the current source 12 (the current value is referred to as an "I2") are provided for the capacitor 10. These current sources are variable current sources. The charge current I1 supplied by the current source 11 to the capacitor 10 depends on the time that has elapsed since the start of the lighting of the discharge lamp 6. The charge current I2, supplied by the current source 12 to the capacitor 10, is changed, depending on the level of the lamp voltage. That is, the current I1 or I2, or a current "I1+I2", is supplied by the current source to the capacitor 10 in accordance with the state of the discharge lamp 6.

The power controller 13 includes an error amplifier 13*a* for power calculation, and a power control and addition unit 13*b*. The terminal voltage of the capacitor 10 (hereinafter referred to as "VC") is applied to the error amplifier 13*a* through the power control and addition unit 13*b*. As a result, more power is added to the constant power, and the obtained power is supplied to the error amplifier 13*a*. When the voltage VC of the capacitor 10 is increased by the charge current supplied by the current source 11 or 12, transient power control is provided to reduce the power supplied to the discharge lamp 6 in accordance with the rise in the voltage. At the succeeding stage, the power controller 13 transmits to the operation controller 14 a control output consonant with the VC.

The operation controller 14 receives a control signal from the power controller 13 and controls the output of the DC—DC converter 3. Based on the results obtained by comparing the level of the control voltage applied by the power controller 13 with the level of a lamp wave supplied by a circuit (not shown), a control signal is transmitted to the DC—DC converter 3, and a switching device, such as an FET that constitutes the DC—DC converter 3, is driven.

In FIG. 2, a flyback configuration including a transformer T and a switching device SW is shown, and a rectifying and smoothing circuit 15, constituted by a diode D and a capacitor C, is provided on the secondary side of the transformer T. When the PWM (Pulse Width Modulation) method is employed as a switching method, a PWM comparator constituting the operation controller 14 obtains a signal pulse having a rectangular wave shape (PWM pulse) by performing a level comparison with the lamp wave, and transmits the pulse signal through a buffer (not shown) to the control terminal (the gate of the FET) of the switching device SW. The PFM (Pulse Frequency Modulation) may be employed as another switching method.

Figure 3:
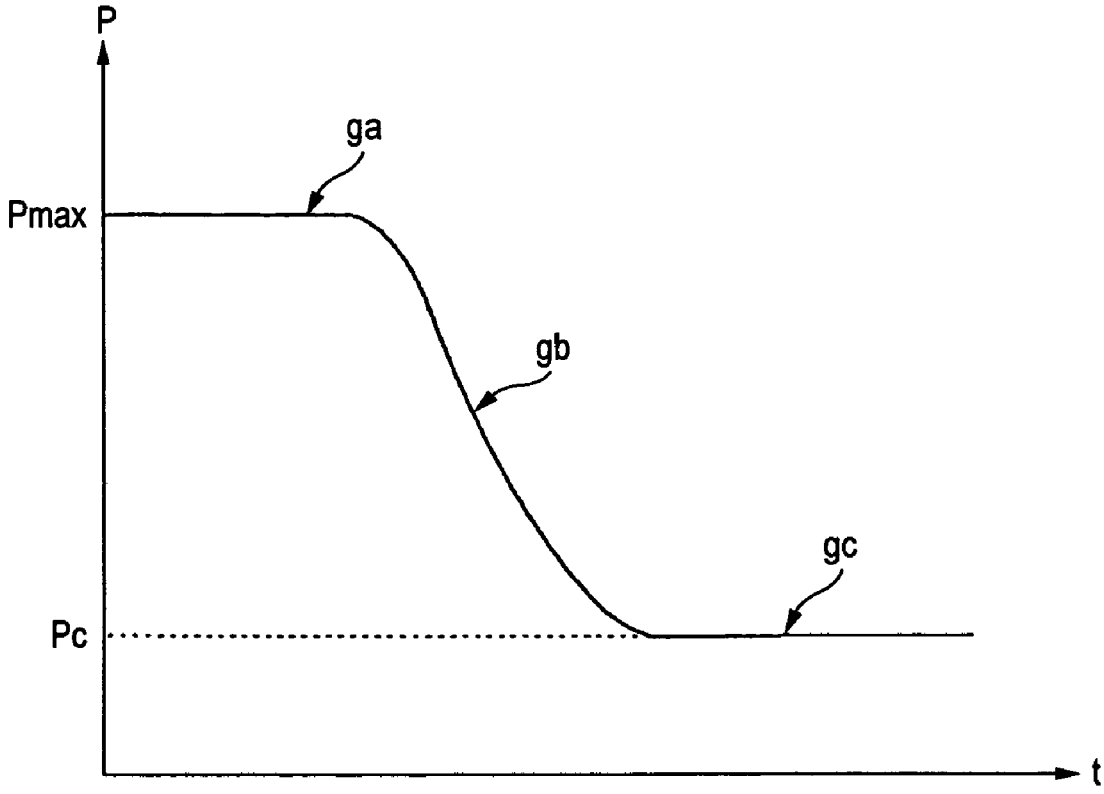
FIG. 3 is a schematic graph showing the time-transient change of power.

FIG. 3 is a schematic graph showing the time-transient change in power, while the horizontal axis represents a time "t" that has elapsed since the lighting start, and the vertical axis represents a power "P", which is supplied to the discharge lamp 6.

Graph segments ga, gb and gc in FIG. 3 are defined as follows.

"ga": a line segment representing the maximum value "Pmax" of the power supplied to the discharge lamp 6

"gb": a line segment related to the emission acceleration control for the discharge lamp 6, and inclined right upward to connect the segments ga and gc "gc": a line segment representing the rated value "Pc" of the power supplied to the discharge lamp 6

When the VC of the capacitor 10 is zero, as is indicated by the graph line ga, the power Pmax is output for supply to the discharge lamp 6. As the voltage VC is increased, the power P is reduced. When the voltage VC reaches a predetermined voltage (hereinafter referred to as an "Eref"), the rated power Pc is output.

Figure 4:
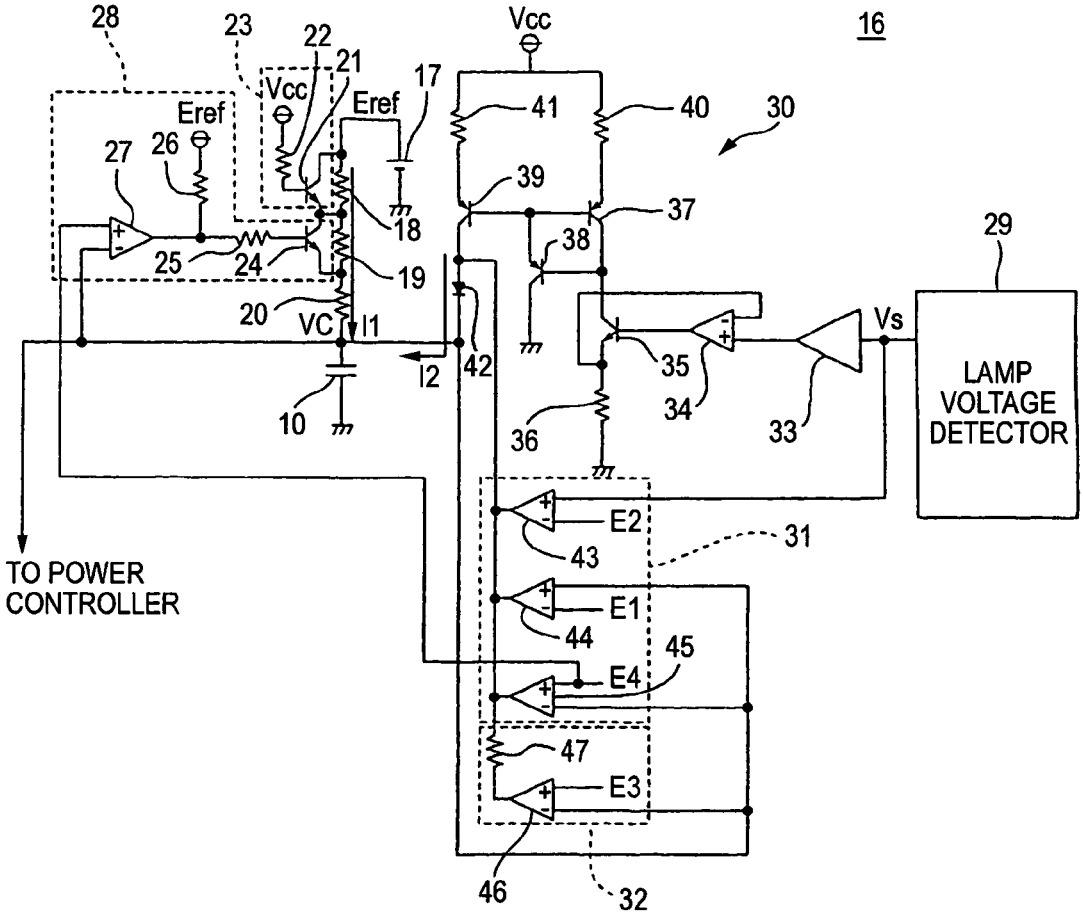
FIG. 4 is a diagram showing an exemplary, non-limiting embodiment of the present invention circuit structure for the emission acceleration control.

FIG. 4 is a diagram showing an exemplary, non-limiting circuit configuration 16 for emission accelerating control. A constant voltage source 17 for supplying the voltage Eref is connected to the capacitor 10 through three series resistors 18, 19 and 20 to constitute the current source 11.

A circuit unit 23, including an NPN transistor 21 and a resistor 22, is provided in parallel to the resistor 18. The collector for the NPN transistor 21 is connected to the constant voltage source 17 and the emitter of the NPN transistor 21 is connected to respective nodes of the resistors 18 and 19. A predetermined voltage (hereinafter referred to as a "Vcc") is applied to the base of the NPN transistor 21 through the resistor 22.

A circuit unit 28, including an NPN transistor 24, resistors 25 and 26 and a comparator 27, is provided for the resistor 19. The collector of the NPN transistor 24 is connected to the node of the resistors 18 and 19, and the emitter of the NPN transistor 24 is connected to a node of the resistors 19 and 20. The base of the NPN transistor 21 is connected to the output terminal of the comparator 27 through the resistor 25.

The negative input terminal of the comparator 27 is connected to the capacitor 10. The positive input terminal of the comparator 27 is connected to the positive input terminal of a comparator 45 described below. The voltage Eref is applied to the resistor 26 connected to the output terminal of the comparator 27.

A lamp voltage detector 29, a current mirror circuit 30 and circuit units 31 and 32 are provided as a system for supplying the current I2 to the capacitor 10.

The lamp voltage detector 29 applies a detected voltage (hereinafter referred to as a "Vs"), which corresponds to the lamp voltage VL of the discharge lamp 6, through an amplifier 33 to the non-inversion input terminal of an operating amplifier 34. The signal output by the operating amplifier 34 is transmitted to the base of an NPN transistor 35. The emitter of the NPN transistor 35 is connected to the inversion input terminal of the operating amplifier 34 and is grounded through a resistor 36.

The current mirror circuit 30 is constituted by using a plurality of PNP transistors 37 to 39.

The collector of the PNP transistor 37 is connected to the collector of the NPN transistor 35, and the predetermined voltage Vcc is applied to the emitter of the PNP transistor 37 through a resistor 40.

The collector of the PNP transistor 38 is grounded, the base of the PNP transistor 38 is connected to the collector of the PNP transistor 37, and the emitter of the PNP transistor 38 is connected to the base of the PNP transistor 37.

The base of the PNP transistor 39 is connected to the base of the PNP transistor 37 and the emitter of the PNP transistor 38. The predetermined voltage Vcc is applied to the emitter of the PNP transistor 39 through a resistor 41.

The collector of the PNP transistor 39 is connected to the anode of a diode 42, and the cathode of the diode 42 is connected to the capacitor 10 to supply the current I2 to the capacitor 10.

The circuit unit 31 is constituted by three comparators 43, 44 and 45. The detected voltage Vs indicating the lamp voltage VL is applied to the positive input terminal of the comparator 43, and a predetermined reference voltage (hereinafter referred to as an "E2") is applied to the negative input terminal of the comparator 43. The output terminal of the comparator 43 is connected to the collector of the PNP transistor 39.

The positive input terminal of the comparator 44 is connected to the capacitor 10 (or the cathode of the diode 42), and a predetermined reference voltage (hereinafter referred to as an "E1") is applied to the negative input terminal of the comparator 44. The output terminal of the comparator 44 is connected to the collector of the PNP transistor 39.

The negative input terminal of the comparator 45 is connected to the capacitor 10, and a predetermined reference voltage (hereinafter referred to as an "E4") is applied to the positive input terminal of the comparator 45. The output terminal of the comparator 45 is connected to the collector of the PNP transistor 39, and the reference voltage E4 is also applied to the positive input terminal of the comparator 45.

The circuit unit 32 is constituted by using a comparator 46 and a resistor 47. The negative terminal of the comparator 46 is connected to the capacitor 10, a predetermined reference voltage (hereinafter referred to as an "E3") is applied to the positive input terminal of the comparator 46, and the output terminal of the comparator 46 is connected to the collector of the PNP transistor 39 through the resistor 47.

The operation of the thus arranged lighting circuit will now be described while referring to FIG. 5.

Figure 5:
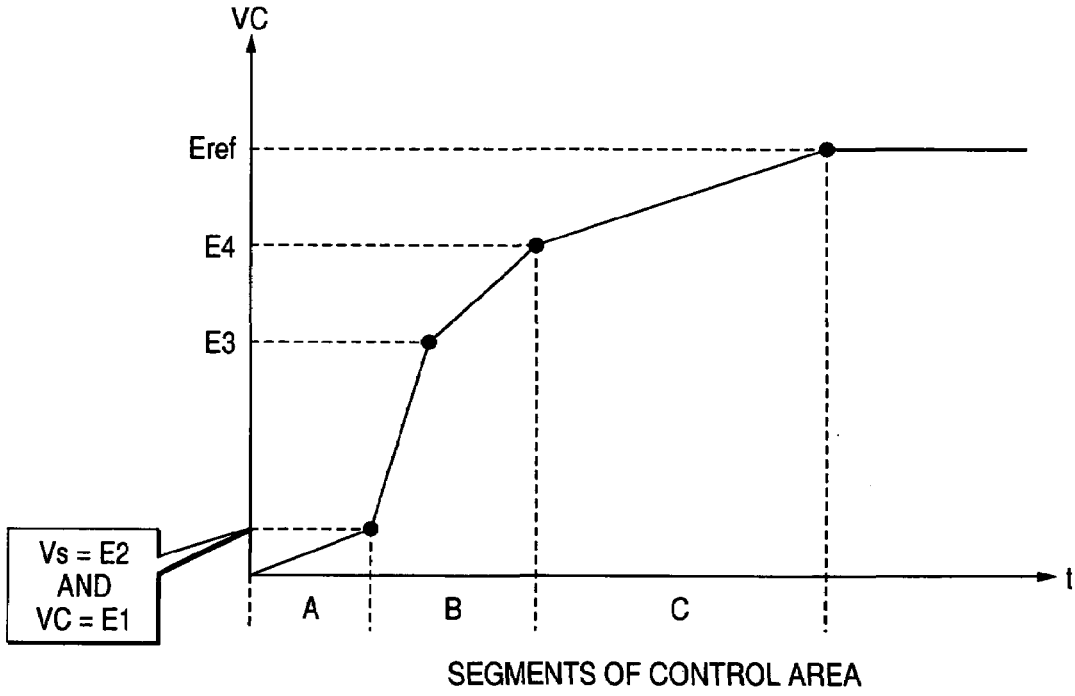
FIG. 5 is a graph showing the segments of a control area for explaining the operation of the circuit shown in FIG. 4.

FIG. 5 is a graph showing exemplary, non-limiting segments of a control area. The horizontal axis represents time "t" and the vertical axis represents the voltage VC of the capacitor 10 to show the time-transient change in the voltage VC. The voltages E1 to E4 and Eref are defined as described above, and the relationship of the voltage levels E1<E3<E4<Eref is established.

For the emission acceleration control for shifting, from the start of the lighting, the discharge lamp 6 to the steady state, the control area is divided into a plurality of control area segments (A to C). The control area is divided into multiple segments, so that for each area segment, the change in the power supplied to the discharge lamp 6 (reduction rate) can be controlled. For example, the supply of the current I1 or I2 to the capacitor 10 is permitted for a specific control area segment, and is inhibited for another control area segment, so that the rate at which the voltage of the capacitor 10 is increased (i.e., the rate at which the power supplied to the discharge lamp 6 is reduced) can be controlled.

The control area segments A to C are provided. As is shown in FIG. 5, the degree to which the voltage VC is increased differs depending on the area segments.

The first area A corresponds to a period during which the supply of a power larger than a rated value is required, while taking into account the time required for the iodide contained in the discharge lamp to evaporate. Since in the second area B the luminous flux rises sharply in accordance with the evaporation of the iodide, the power supplied to the discharge lamp 6 must be quickly reduced. Therefore, in the second area B, the rate at which the voltage VC is increased is greater than in the other areas. In the third area C, the lamp voltage VL is indicated as an almost steady value; however, since the temperature of the discharge lamp 6 has not yet reached the temperature of the steady state, the power supplied to the discharge lamp 6 must be gradually reduced near the rated value (the range following the point whereat VC=Eref is established corresponds to the steady area).

It is preferable that the level of the terminal voltage of the capacitor 10 or the level of the lamp voltage VL be employed to determine the shifting of the emission acceleration control from a specific control area segment to another control area segment. However, the present invention is not limited thereto, and other equivalents as would be understood by one of ordinary skill in the art may be substituted therefore.

For the operation of the lighting circuit in the first area A, the NPN transistor 21 of the circuit unit 23 is turned on, and since VC<E4 is established, the NPN transistor 24 is turned on in accordance with an H (high) signal that is output by the comparator 27 of the circuit unit 28. Therefore, the current I1, from the constant voltage source 17, is supplied through the resistor 20 to the capacitor 10.

The supply of the current I2 to the capacitor 10 is halted in accordance with L (low) signals that are output by the comparators 43 and 44 of the circuit unit 31.

Therefore, the rate at which power supplied to the discharge lamp 6 is reduced is defined as the rate at which the voltage VC is increased when the capacitor 10 is charged by receiving, through the resistor 20, the current I1 consonant with a specific time constant. That is, in the first area A at the initial time during the period of the transition to the steady state, only the current I1 is supplied to the capacitor 10, and the degree of the rise in the voltage of the capacitor 10 is determined.

It is preferable, based on the statistical view, that immediately before the luminous flux rises sharply, in accordance with the state of the discharge lamp 6, the emission acceleration control be shifted from area A to area B. The shifting condition is defined as VC≧E1 and Vs≧E2. That is, "VC≧E1" means that, in the first area A, the capacitor 10 is charged using a specific time constant so that the voltage is increased. Thereafter, a specific time period or longer elapses. "Vs≧E2" means that the lamp voltage VL has been increased and is equal to or higher than the voltage represented by E2. When these two conditions are established, the emission accelerating control is shifted to the process for increasing the rate at which the supplied power is reduced.

For example, for a discharge lamp for which the initial lamp voltage at the lighting time is high, the supply of power is continued in the first area A for at least a specific period of time. For a discharge lamp for which the initial lamp voltage at the lighting time is low, while taking into account the delay in the rise of the luminous flux, the supply of power in the first area A is continued, even after a specific time period has elapsed, until the lamp voltage VL reaches and corresponds to the voltage represented by E2. Therefore, the affect produced by the variance in the characteristic of the discharge lamp 6 can be suppressed. As described above, when the terminal voltage VC of the capacitor 10 is equal to or higher than the threshold value (E1), and the lamp voltage VL is equal to or higher than the threshold value (corresponds to E2), preferably the emission acceleration control is shifted from area A to area B.

In area B, while taking the sharp rise in the luminous flux into account, the current I1 of the constant voltage source 17 and the current I2 that depends on the level of the lamp voltage VL are supplied to the capacitor 10 to increase the rate at which the voltage VC rises. That is, when VC<E3 is established, the current I1, as well as in area A, is supplied to the capacitor 10. To supply the current I2, the voltage Vs is applied to the NPN transistor 35, through the amplifier 33 and the operating amplifier 34, the collector current is returned by the current mirror circuit 30, and the collector current of the PNP transistor 39 is supplied through the diode 42 to the capacitor 10 (as the Vs rise rate is increased, the current I2 is also increased). The outputs of the comparators 43, 44 and 45 are all defined as H (high) impedances since Vs>E2, E1<VC and VC<E4 are established.

During the period wherein VC<E3, the output of the comparator 46 in the circuit unit 32 is defined as the H impedance, and when VC=E3 is established, the output level goes to the L (low) signal.

Since in the first half of area B the capacitor 10 is charged by using two currents, I1 and I2, the voltage VC is increased sharply, and the power supplied to the discharge lamp 6 is reduced quickly. Therefore, if this control state is maintained in the last half of area B, there will be too great a reduction in the power supplied, and the luminous flux will fall.

Therefore, it is preferable that area B be further divided into smaller segments, and that the current I2 be changed in each segment, so that the rate at which the supplied power is reduced can be precisely controlled in area B.

In this embodiment, after VC=E3 is established (in the last half of area B), the value of the current I2 is reduced by the comparator 46 of the circuit unit 32 (a current sink).

The time when the emission acceleration control is shifted from area B to area C is determined in accordance with the condition VC=E4. That is, when the voltage VC is equal to or higher than the threshold value (E4), the emission acceleration control is shifted from area B to area C.

In area C, since the control must be performed to maintain the constant lamp voltage VL at substantially a constant level and to thermally stabilize the discharge lamp 6, the supply of the current I2 to the capacitor 10 is inhibited. That is, since VC>E4 is established, the signal output by the comparator 44 of the circuit unit 31 goes to level L, and the supply of the current I2 to the capacitor 10 is halted.

Further, the L signal is output by the comparator 27 of the circuit unit 28, and the NPN transistor 24 is turned off. Then, the current I1, from the constant voltage source 17, is supplied through the resistors 19 and 20 to the capacitor 10 (the time constant is increased), and the VC rising rate in area C is smaller than the VC rising rate in area A. This control process is performed because the supplied power is gradually reduced to shift the discharge lamp 6 to the steady state. For example, but not by way of limitation, when the same power reduction rate as in area A is set for area C (the time constant is the same), undershoot of the luminous flux will occur, and such a phenomenon must be avoided. Since the supply of the current I2 is halted in area C, the current I1 is reduced and the charging of the capacitor 10 is performed.

As described above, among the three area segments of the control area, in the second area B and further, in the middle of the period of the transition to the steady state, the current I1 and the current I2 are supplied to the capacitor 10. In the first area A, at the start of the period of transition to the steady state, and in the third area C, at the end of the period of transition to the steady state, only the current I1 is supplied to the capacitor 10. That is, in areas A and C, it is preferable that the rate at which the terminal voltage VC of the capacitor 10 is reduced be low, so as to gradually reduce the rate at which the power is supplied.

In this embodiment, three control area segments have been employed for the power control provided during the transition period; however, the control area may be divided into more segments (it should be noted, however, that preferably the circuit is designed while taking into account a disadvantage, such as the complexity of the circuit structure). However, the present invention is not limited thereto, and equivalents as would be known by those of ordinary skill in the art may be substituted therefore.

For the restarting of the discharge lamp 6, two cases apply: the case (i.e., cold start) wherein the discharge lamp 6 is cool when lighted, since a comparatively long period has elapsed since it was last lighted, and a case (i.e., hot start) when the discharge lamp 6 is lighted while it is still comparatively warm because a light-off period (the elapsed time following the immediately preceding turn-off time) is short.

In the second case, when the same power is supplied to the discharge lamp 6, overshoot of the luminous flux or deterioration of the luminous flux occurs because excessive power is supplied. Therefore, it is preferable that the initial power supplied to the discharge lamp 6 be designated in accordance with the length of the period during which the discharge lamp is off. An exemplary, non-limiting detection method can be a method whereby, while the discharge lamp is on, the capacitor 10 is fully charged and when the discharge lamp is turned off in accordance with a turn-off instruction, discharging of the capacitor 10 begins. When only a small charge remains on the capacitor 10 at the next start time, this means that a long period has elapsed, and in this case, only the terminal voltage of the capacitor 10 need be detected.

With the configuration shown in FIG. 4, the period during which the discharge lamp 6 is in the off state is detected by using the discharging path from the capacitor 10, while taking into account the fact that when the lighting of the discharge lamp 6 is started, the charging path is formed to supply the current I1 to the capacitor 10. That is, the discharging path from the capacitor 10 is formed in the direction opposite to that of the charging path when the discharge lamp 6 is turned off, or when the supply of power to the lighting circuit is halted. Therefore, the discharge time constant defined for the capacitor 10 is greater than the charging time constant for the capacitor 10, so that the counting means for the light off period can be provided.

When the discharge lamp 6 is turned off, the Eref of the constant voltage source 17 becomes zero, and the discharging of the capacitor 10 is performed along the path opposite the path for charging the current I1, and as time elapses, the voltage VC is lowered. For a hot start when the light-off period is short, the lighting is initiated under a condition wherein the voltage VC is slightly lower than the level in the fully charged state, so that the power supplied at the initial lighting time can be suppressed. For a cold start, the lighting is initiated at VC=0. As explained while referring to FIG. 5, power control is provided in accordance with whether the area is A, B or C. When the light-off period is shorter than the period required for a cold start, the power supplied at the lighting start time is controlled based on the value of the voltage VC that is consonant with the charge remaining on the capacitor 10.

The discharge time constant for the capacitor 10 should be set so it is greater than the charge time constant. Otherwise the discharging will be performed too fast, and for detecting the light-off period, the discharge time constant will not be useful. Therefore, the resistances are changed by using the circuit units 23 and 28. That is, when the discharge lamp 6 is turned off, the NPN transistors 21 and 24 are in the off state, and the discharge time constant is determined by the total value (about several hundred kilos to several mega Ω) of the resistances of the three resistors 18 to 20, which are connected in series. So long as the output impedance of the constant voltage source 17 affects the discharging only to the degree equivalent to an error, there is no problem with the discharging path. When the effect is more than an error, a resistor (having a resistance of about several tens to several kilo Ω) can be provided parallel to the constant voltage source 17 and discharging through this resistor can be performed.

As discussed above, according to the first aspect of the invention, the related art concept of the control line need not be employed to control power supplied to a discharge lamp during the transition period. Thus, the circuit structure can be simplified and the multiplicity of usages is available. Further, when the present invention is applied for a lighting circuit for a discharge lamp that contains no mercury or only a small amount of mercury, the rate at which the power supplied is reduced can be controlled in accordance with the period and the lamp voltage, so that the starting period can be reduced and stabilized.

According to the second aspect of the invention, the control area is divided into multiple segments, and the change in the power supplied to the discharge lamp (the reduction rate) can be determined for each segment.

According to the third aspect of the invention, the rate at which the terminal voltage of the capacitor is increased is reduced in the first and the third areas, so that the rate at which the power supplied is gradually lowered can be reduced to prevent a rapid drop in the power supplied.

According to the fourth aspect of the invention, the process can easily be performed for determining the condition when the control is shifted from one control area segment to another.

According to the fifth aspect of the invention, the power control can be provided in accordance with variances in the characteristics of the discharge lamp, while taking into account the rise in the lamp voltage and the time that has elapsed since the lighting of the discharge lamp was started.

According to the sixth aspect of the invention, in the third area, since the rate is reduced at which the power supplied is lowered, a discharge lamp can be smoothly shifted to the steady state.

According to the seventh aspect of the invention, the rate at which the power supplied is lowered can be delicately controlled in the second area.

According to the eighth aspect of the invention, for the capacitor 10, a discharging path separate from a charging path need not be employed to detect the period a discharge lamp has been off (only the time constant is changed for the same path). Therefore, the circuit structure is simplified, and the costs can be effectively reduced.

It will be apparent to those skilled in the art that various modifications and variations can be made to the described preferred embodiments of the present invention without departing from the spirit or scope of the invention. Thus, it is intended that the present invention cover all modifications and variations of this invention consistent with the scope of the appended claims and their equivalents.

What is claimed is:

1. A discharge lamp lighting circuit comprising:

an emission acceleration controller that detects a lamp voltage for a discharge lamp and supplies power greater than a rated value when the discharge lamp is initially lighted, and gradually reduces the power supplied thereafter to shift the discharge lamp to a steady state of operation, wherein the emission acceleration controller provides power control so that the power supplied decreases as a voltage for a capacitor comprising the emission acceleration controller increases, and wherein a charging current is supplied to the capacitor by a plurality of power sources having a first current that depends on time elapsed since the initially lighting of the discharge lamp, and a second current that depends on a level of the lamp voltage.

2. The discharge lamp lighting circuit of claim 1, wherein said discharge lamp comprises is substantially mercury-free.

3. The discharge lamp lighting circuit of claim 1, wherein said emission acceleration controller detects said lamp voltage via a detector comprising one of (a) a device that directly detects at least one of voltage and current of said discharge lamp, and (b) a device that detects an equivalent voltage for at least one of the voltage and the current of the discharge lamp.

4. The discharge lamp lighting circuit of claim 3, where said equivalent voltage detecting device comprises a voltage divided resistor that detects said discharge lamp voltage, and a current detection resistor that detects said discharge lamp current.

5. The discharge lamp lighting circuit of claim 1, wherein said emission acceleration controller comprises:

a power controller having, an error amplifier for power calculation and a power control and addition unit wherein a terminal voltage of the capacitor is applied to the error amplifier through the power control and addition unit, and when the voltage of the capacitor is increased by the charge current supplied by the first current or the second current, transient power control is provided to reduce the power supplied to the discharge lamp in accordance with the rise in the voltage; and an operation controller that receives a first control signal from the power controller and controls the output of a DC—DC converter coupled between a power source and said discharge lamp, by comparing the level of the control voltage applied by the power controller with the level of a lamp wave and generates a second control signal that is transmitted to said DC—DC converter and a switching device.

6. The discharge lamp lighting circuit of claim 5, wherein said DC—DC converter comprises:

a flyback configuration including a transformer and a switching device;

a rectifying and smoothing circuit comprising a diode coupled to said transformer and a capacitor coupled to said diode on the secondary side of the transformer.

7. The discharge lamp lighting circuit of claim 5, wherein said plurality of power sources comprise:

a constant voltage source for supplying the voltage coupled to the capacitor through a plurality of first resistors coupled in series to generate the first current source, wherein a first circuit unit is coupled in parallel with a first one of said plurality of resistors to provide a predetermined voltage to a second circuit unit coupled in parallel with a second one of said plurality of resistors, said second circuit unit comprising an NPN transistor, seconds resistors and a first comparator, wherein a negative input terminal of the comparator is connected to the capacitor, and a positive input terminal of the first comparator is connected to the positive input terminal of a second comparator; and a system providing said second current source to said capacitor, comprising a lamp voltage detector that applied said detected lamp voltage to a plurality of amplifiers to generate a signal output to a plurality of transistors to generate a lamp voltage detector output, a current mirror circuit comprising a plurality of transistors to generate a current based on said lamp voltage detector output and a predetermined voltage, and third and fourth circuit units that supply the second current to the capacitor based on respective predetermined reference voltages.

8. The discharge lamp lighting circuit according to claim 1, wherein from the start of the lighting of the discharge lamp until the discharge lamp is shifted to the steady state, a plurality of control areas are defined by at least one of (a) permitting the supply of one of the first current and the second current to the capacitor and (b) inhibiting the supply of one of the first current and the second current to the capacitor.

9. The discharge lamp lighting circuit according to claim 8, wherein said shifting from one of said control areas to a next one of said control areas is determined based on at least one of the level of a terminal voltage at the capacitor or the level of the lamp voltage.

10. The discharge lamp lighting circuit according to claim 2, wherein when the lighting of the discharge lamp is started, a charging path is formed for supplying the first current to the capacitor, and when the discharge lamp is turned off or the supply of power to the discharge lamp lighting circuit is halted, a discharging path to the capacitor is formed in the direction opposite to that of the charging path, and a discharge time constant for the capacitor is set to a value greater than a charge time constant for the capacitor.

11. The discharge lamp lighting circuit according to claim 8, wherein the control areas comprise:

a first area at the start of the period of transition to the steady state;

a second area in a middle period of said transition to the steady state, wherein the first current and the second current are supplied to the capacitor; and a third area at the end of the period of transition to the steady state, wherein in the first area and the third area only the first current is supplied to the capacitor.

12. The discharge lamp lighting circuit according to claim 11, wherein said shifting from one of said control areas to a next one of said control areas is determined based on at least one of the level of a terminal voltage at the capacitor or the level of the lamp voltage.

13. The discharge lamp lighting circuit according to claim 11, wherein when the terminal voltage of the capacitor is equal to or greater than a first threshold value and the lamp voltage is equal to or greater than a lamp voltage threshold value, the emission acceleration control is shifted from the first area to the second area, and when the terminal voltage of the capacitor is equal to or greater than a second threshold value, the emission acceleration control is shifted from the second area to the third area.

14. The discharge lamp lighting circuit according to claim 11, wherein a rate at which a terminal voltage of the capacitor rises in the third area is slower than a rate at which the terminal voltage of the capacitor rises in the first area.

15. The discharge lamp lighting circuit according to claim 11, wherein the second area is further divided into a plurality of area segments, and the second current is changed in each of the area segments.

16. The discharge lamp lighting circuit according to claim 11, wherein when the lighting of the discharge lamp is started, a charging path is formed for supplying the first current to the capacitor, and when the discharge lamp is turned off or the supply of power to the discharge lamp lighting circuit is halted, a discharging path to the capacitor is formed in the direction opposite to that of the charging path, and a discharge time constant for the capacitor is set to a value greater than a charge time constant for the capacitor.

* * * * *